US005682084A

United States Patent [19]

Langlois et al.

[11] Patent Number: 5,682,084

[45] Date of Patent: Oct. 28, 1997

[54] GRID ELECTRON TUBE WITH A FOLDED CAVITY STRUCTURE

[75] Inventors: Michel Langlois; Guy Clerc, both of Thonon les Bains, France

[73] Assignee: Thomson Tubes Electroniques, Velizy, France

[21] Appl. No.: 406,598

[22] Filed: Mar. 20, 1995

[30] Foreign Application Priority Data

Dec. 20, 1994 [FR] France ..... 94 15319

[51] Int. Cl.[6] ..... H01J 25/18

[52] U.S. Cl. ..... 315/5.32; 315/5.37; 330/45; 313/293

[58] Field of Search ..... 315/5.32, 5.37; 330/45; 313/293

[56] References Cited

U.S. PATENT DOCUMENTS 2,289,846 7/1942 Litton ..... 315/5.32 X 2,368,031 1/1945 Llewellyn ..... 330/45 X 2,425,748 8/1947 Llewellyn ..... 315/5.32 X 2,539,210 1/1951 Sloan ..... 315/5.32

2,870,374 1/1959 Papp ..... 315/5.37 X 4,571,525 2/1986 Gerlach et al. ..... 330/45 X

*Primary Examiner*—Benny T. Lee

*Attorney, Agent, or Firm*—Oblon, Spivak, McClelland, Maier & Neustadt, P.C.

[57] ABSTRACT

An electron tube includes cylindrical electrodes which are mounted coaxially. The electrodes include a cathode surrounded by a grid, with the cathode and the grid defining an input resonant cavity having an active zone. The cavity extends on both sides of the active zone. The central part of the active zone is located at a point where the voltage reaches a maximum. The resonant input cavity is folded back on itself so that both ends of the cavity are at the base of the tube.

14 Claims, 7 Drawing Sheets

GRID ELECTRON TUBE WITH A FOLDED CAVITY STRUCTURE

BACKGROUND OF THE INVENTION

1. Field of the Invention

The present invention relates to the grid tubes used notably as television amplifiers or in industrial heating devices, etc. These grid tubes are notably of a triode or tetrode type.

2. Discussion of the Background

FIG. 1*a* gives a schematic view of a semi-tetrode. It has cylindrical electrodes mounted coaxially about an axis XX'.

The central electrode is the cathode K emitting electrons when it is heated. Around this cathode K, there is a control grid G1, a screen-grid G2 and then an anode AN. In a triode, there is no screen-grid.

The cathode K and the control grid G1 form an input resonant cavity 1. The input resonant cavity 1 comprises an active zone 10 between the reference points B and D and extend on either side of this active zone 10 towards the base of the tube between the reference points D and E and towards its top between the reference points A and B. The active zone corresponds to the zone where the electrons sent out by the cathode pass before crossing the control grid G1. The reference point C shows the central part of the active zone.

The input cavity 1 has means 4 to introduce a signal to be amplified. The screen-grid G2 and the anode AN form an output resonant cavity 2. It has means 5 to extract the amplified signal.

The input resonant cavity 1 and output resonant cavity 2 are generally closed, at the base of the tube, by a movable plate-type tuner 3 that enables their resonance frequency to be respectively adjusted.

In the input cavity, it is generally the TEM mode that is set up. The magnetic field $\vec{B}$ and electrical field $\vec{E}$ have been shown. This type of cavity is generally tuned in quarter-wave mode. This means that between the reference point A at the top of the tube on the axis XX' and the reference point E at the plate-type tuner 3, the electrical length I of the input cavity is:

$$l=(2n+1)\lambda/4$$

n is an integer≧0 and λ is the wavelength of the wave set up in the input cavity.

In this TEM mode, the scalar potential V varies between the reference point A and the reference point E as follows:

$$V=\int_0^1 \vec{E}.dl$$

The surface reactive currents I on the walls of the cavity are not constant either. The representation made in FIG. 1*b* of the voltage V and the reactive current I (in terms of absolute value) corresponds to a cavity length I between the reference point A and the reference point E equal to λ/4. An integer n equal to zero has been chosen to simplify the description. The voltage V is shown in a solid line and the reactive current I in dashes.

Between the reference point A and the reference point E, the voltage V follows substantially a quarter sinusoid, this voltage V being the maximum (voltage antinode) for I=0 at the reference point A and the minimum (voltage node) for I=λ/4 at the reference point E. At the top of the tube, at the reference point A, on the axis XX', there is an open circuit and at the base of the tube, at the reference point E, there is a short circuit. Between the reference points B and D, at the two ends of the active end zone 10, the voltage V and the current I vary. This means that the cathode K is not affected homogeneously in its active part 10. It is also noted in FIG. 1*b* that the reactive current I is greater at the reference point D than at the reference point B. This means that there is a heating of the tube in the part (reference point D) of the active zone 10 closest to its base while it is part of the active zone 10 that is the least affected. Indeed the peak current given is greater at B than it is at D.

In this type of tube, the height of the active zone (interval BD) is limited by the frequency and the power of the tube. The greater the frequency, the greater the voltage variation V in the active zone 10. The power of the tube is limited because a compromise has to be made between the height of the active zone 10 and the diameter of the cathode K. For example, the most powerful tubes working in the UHF range have a cathode K whose diameter is about 40 mm and whose height of the active zone is equal to about 2 cm.

About forty years ago, to obtain a tube having greater efficiency and greater power and higher frequency, it was proposed to place a voltage antinode V in the central part of the active zone 10.

FIG. 2*a* gives a schematic illustration of such a tube. This figure can be compared to FIG. 1*a* and the elements that correspond to one another bear the same references, which may not be all described in detail.

Now, the input cavity 1' has been made between the reference points A' and E'. The reference point C' corresponding to the central part of the active zone 10 is located on the voltage V antinode and hence a node of reactive current I. The input cavity 1' is tuned in a half-wave mode. This means that between the reference point A' (the top of the cavity) and the reference point E' (the base of the tube), the electrical length I' is equal to:

$$l'=n\lambda/2$$

n integer>0.

In the example of FIGS. 2*a*, 2*b*, n is chosen as being equal to 1 for purposes of simplification. Now, the voltage V develops substantially as a half-sinusoid.

It is the top of the tube that has been modified with respect to the tube of FIG. 1*a*. At A' and E', there are tuning pistons 3 and the input cavity ends in short circuits.

With reference to FIG. 1*a*, the part of the tube located between the reference points A and C has been eliminated and replaced by a part identical to the one located between the reference points C and E. The new input cavity 1' shown in FIG. 2*a* has an active zone 10' between the reference points B' and D' and therefore extends on either side of the active zone 10' towards the base between the reference points D' and E' and towards the top between the reference points A' and B'. This input cavity 1' is now symmetrical with respect to a plane normal to the axis XX' passing through the reference C'. The input cavity 1' shown in FIG. 2*a* is equivalent to two input cavities 1 of FIG. 1*a* mounted upside down with respect to each other. The output cavity 2' is also equivalent to two output cavities of the tube of FIG. 1*a* mounted upside down with respect to each other.

This configuration gives good results from the electrical point of view. In the active zone 10', the voltage V varies very little and the current I is not very great. By contrast, it is very difficult to make this structure from the mechanical viewpoint because it is very difficult to keep a proper degree of coaxiality between the cathode K and the control grid G1 since they are now fixedly joined by their two ends to the base and top of the tube. The distance between the control grid G1 and the cathode K is some tenths of a millimeter in the active zone while the height of the active zone is equal to some tens of millimeters.

The present invention seeks to overcome these drawbacks. It proposes a grid tube that has electrical performance characteristics comparable to those of the tube of FIG. 2*a* but is far easier to manufacture, easier to install and therefore costs less.

SUMMARY OF THE INVENTION

The electron tube according to the invention has electrodes that are on the whole cylindrical mounted coaxially about an axis including a cathode surrounded by a grid. The cathode and the grid contribute to the demarcation of an input resonant cavity having an active zone, this cavity extending on either side of the active zone. The resonant input cavity is folded on itself towards the axis on one side of the active zone. The central part of the active zone is subjected to a voltage antinode Preferably, the input cavity ends in two extremities that contribute to forming the base of the tube.

At least one of the extremities of the input cavity may be closed by a plate-type tuner so as to match the frequency of the tube. To work in the lower frequencies of the frequency range of the tube, the two extremities of the cavity may be closed by a plate-type tuner.

To work in the higher frequencies of the frequency range of the tube, at least one extremity of the tube may form an open circuit. To work in an intermediate part of the frequency range of the tube, at least extremity of the tube ends in a capacitor connected between the grid and the cathode.

The capacitor could comprise a dielectric element placed flat against one of the electrodes by means of a conductive clamping or gripping device and in contact with the other electrode.

Preferably, the clamping device is detachable and the value of the capacitor may be adjusted as a function of need.

The clamping device may comprise a conductive plug screwed into a collar fixedly joined to the other electrode. A spring may be used to improve the contact between the collar and the plug.

The dielectric element will advantageously be ring-shaped. It may be made of mica.

BRIEF DESCRIPTION OF THE DRAWINGS

Other characteristics and advantages of the invention shall emerge from the following description given by way of a non-restrictive example, illustrated by the appended figures of which.

For the sake of clarity, these figures have not been drawn to scale. In the below described figures, elements that correspond to each other in different figures bear the same reference labels, and may not be described in detail for each figure.

DETAILED DESCRIPTION OF THE PREFERRED EMBODIMENT

Figure 3:
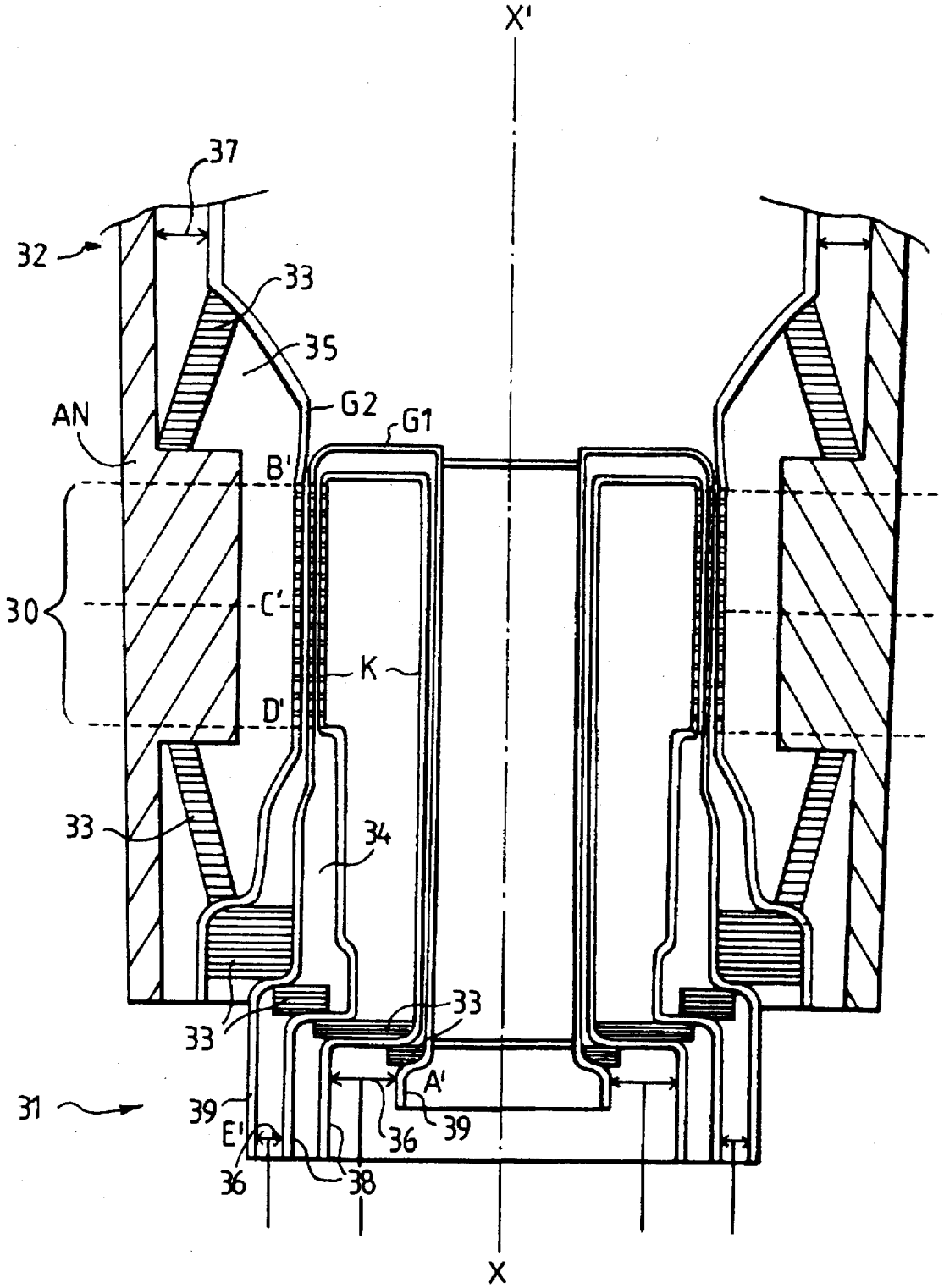
FIG. 3 shows a partial sectional view of a tube according to the invention.

FIG. 3 gives a schematic and partial view of a tube according to the invention.

This tube, in a standard way, has generally cylindrical electrodes mounted coaxially about an axis XX'. There is therefore a cathode K that emits electrons when it is heated. This cathode K is surrounded by a control grid G1 which is itself surrounded by a screen-grid G2 which is itself surrounded by an anode AN. The electrons emitted are accelerated towards the anode AN and go through the grids G1, G2. The cathode K and the control grid G1 contribute to the demarcation of an input resonant cavity 34 into which a signal may be injected. The input cavity 34 has an active zone 30 between the reference points B' and D'. It extends on either side of the active zone 30 between the reference points A' and B' and between the reference points D' and E'. In a standard way, at the base of the tube 31, the electrodes are spaced out from one another by means of insulating spacers 33. These spacers 33 are used to insulate the electrodes electrically from one another and keep them mechanically in position and ensure vacuum tightness in the active part 30 of the electrodes.

The screen-grid G2 and the anode AN define an output resonant cavity 35 whereby it is possible to extract the amplified signal. The output resonant cavity 35 has been shown only partially to avoid overburdening the figure. It is the part of this output cavity 35 located at the top 32 of the tube that has been omitted. In this example, the output cavity 35 ends in a tuning piston 37.

Figure 4A:
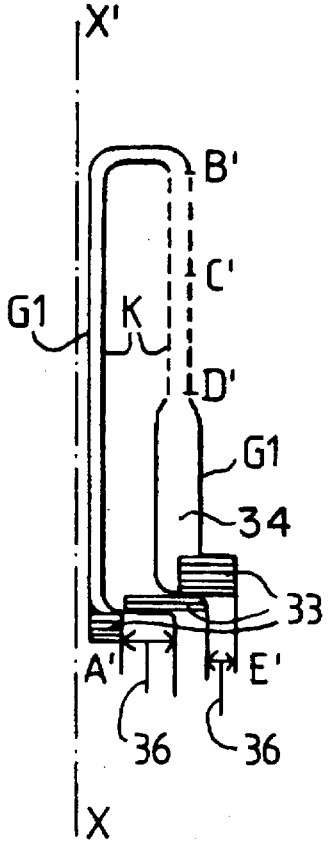
FIGS. 4*a* and 4*b* respectively show a schematic view of the tube of FIG. 3 and a graph of the voltage and current present in the input cavity.
Figure 4B:
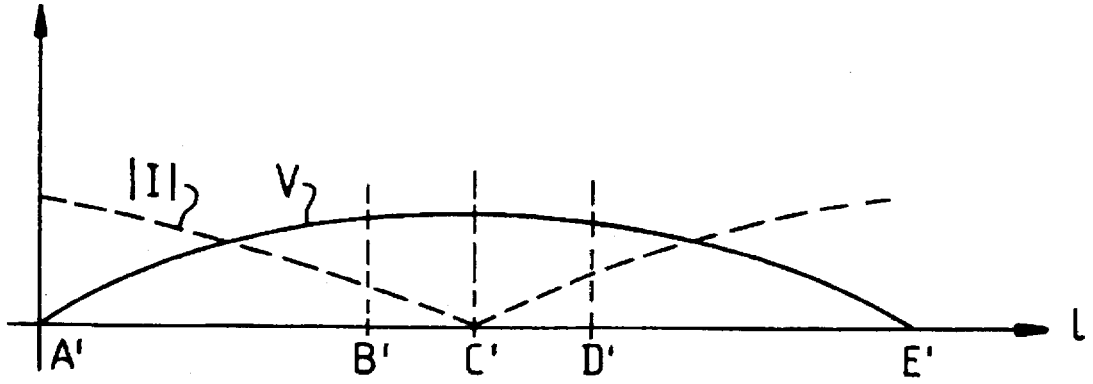

The input cavity 34 is tuned so that the central part (reference C') of the active zone 30 corresponds to a voltage antinode as shown in FIGS. 4*a* and 4*b*.

Instead of having a symmetry with respect to a plane perpendicular to the axis XX' passing through the reference C', the input resonant cavity 34 is folded on itself towards the axis XX' on one side of the active zone 30. The folded part goes from the reference point B' to the reference point A'. The input cavity 34 then has two ends, one being the radially external end (reference E') and the other being the radially internal end (reference A') and these two ends help form the base 31 of the tube. The problems of coaxiality no longer arise. The two ends of the cathode K and of the control grid G1 end conventionally in collars respectively 38, 39. A single connector will be used to receive the tube. A tube according to the invention may then be manufactured and positioned easily at lower cost. With respect to the tube of FIG. 2*a*, the tube according to the invention will be more compact, which is a non-negligible advantage.

The space inside the cathode is not used in conventional tubes. Here, the folded part of the input resonant cavity 34 will be housed.

The frequency tuning of the input cavity 34 may be done by at least one plate-type tuner 36. In FIG. 3, the two ends of the input cavity 34 are closed by such a piston. The input cavity 34 is then tuned in the half-wave mode. FIG. 4*a* gives a schematic view of the input cavity 34 and FIG. 4*b* illustrates the variation of the voltage V and of the reactive current I (in terms of absolute value) as a function of the electrical length I of the cavity. The two plate-type tuners are located at the reference points A' and E' as shown in FIG. 4*a*.

Figures 1A, 1B:
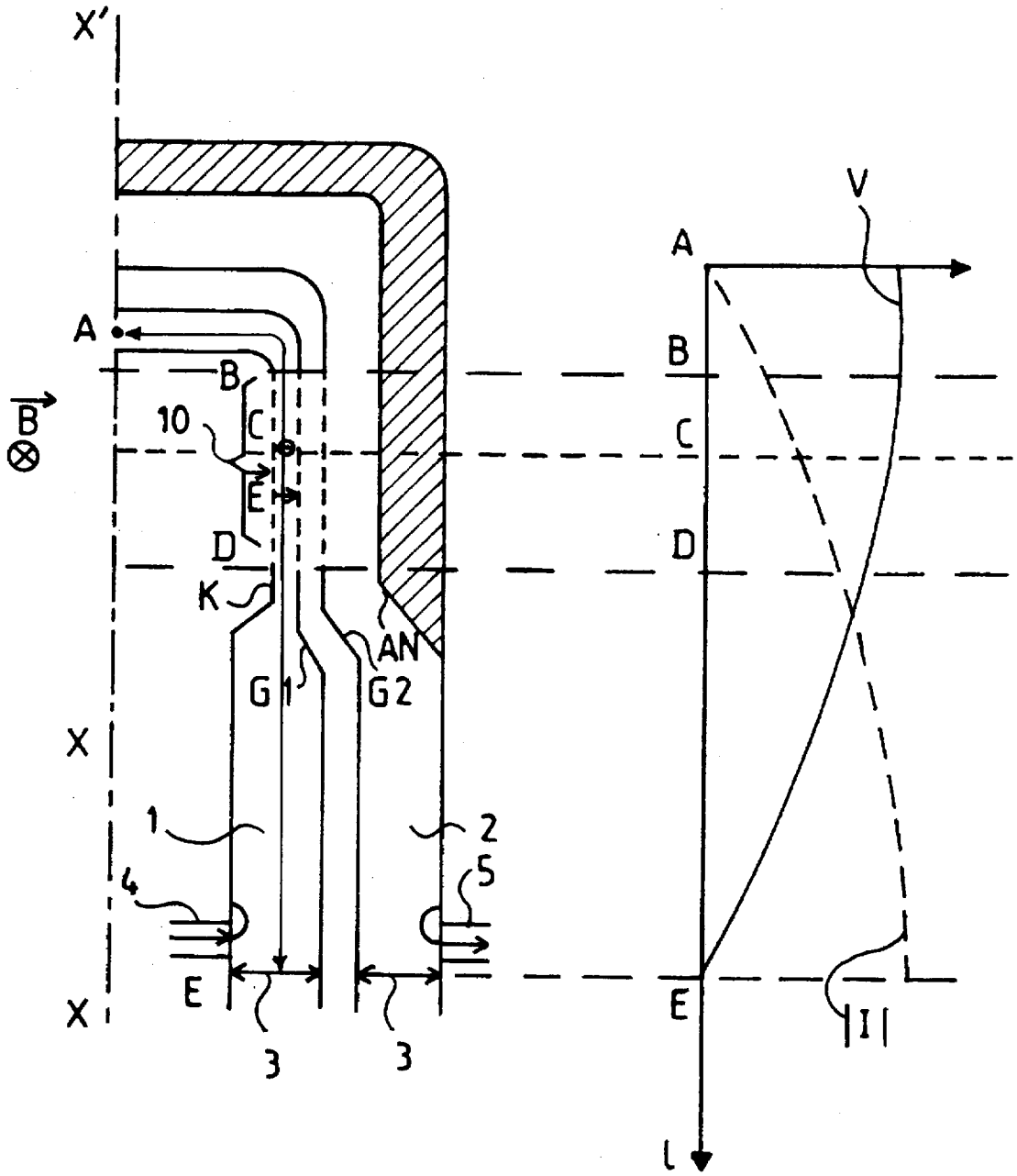
FIG.1a PRIOR ART
FIG.1b PRIOR ART
FIGS. 1*a* and 1*b*, which have already been described, respectively show a schematic view of a known type of tetrode and a graph of the voltage and current present in the input cavity.
Figures 2A, 2B:
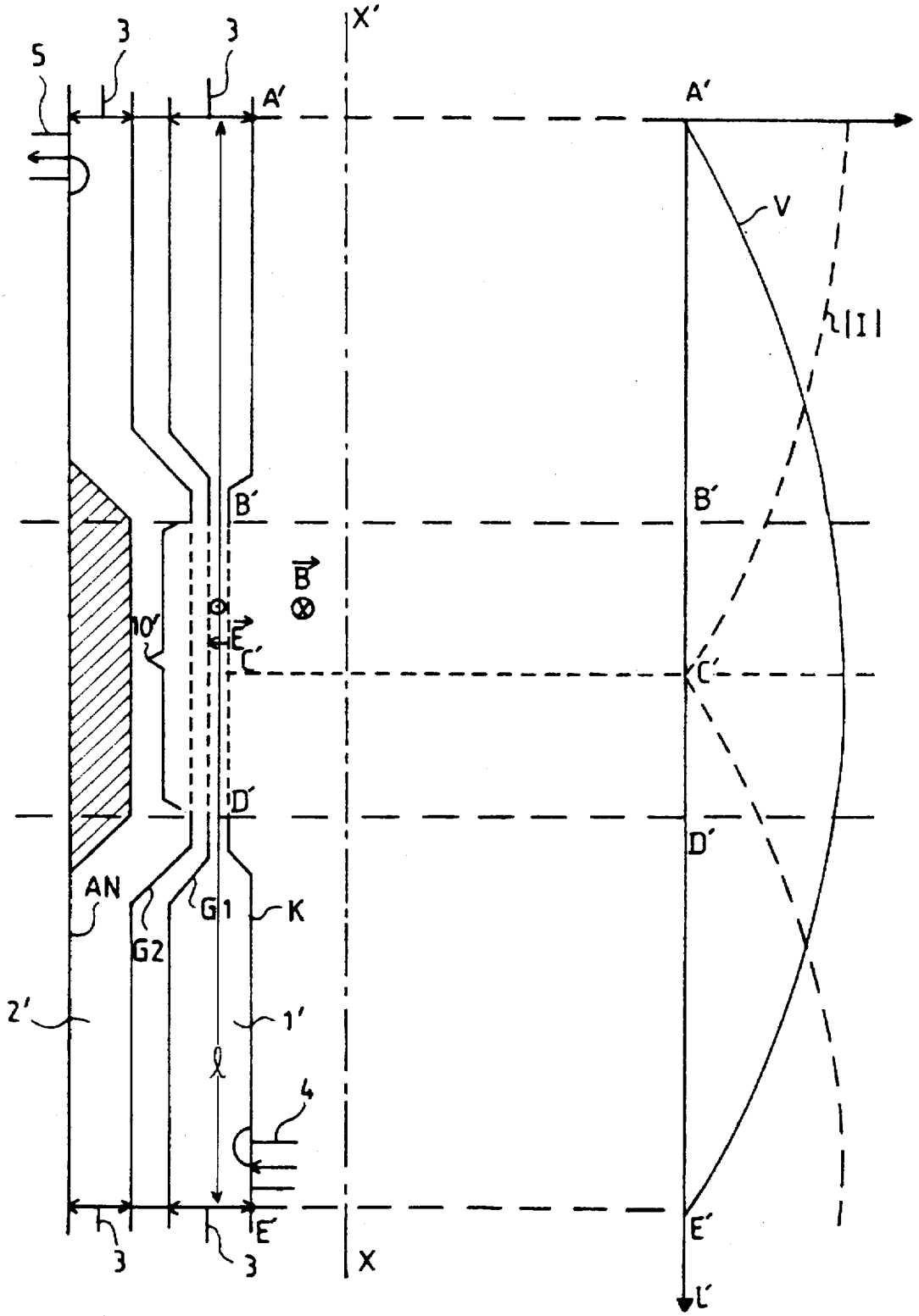
FIG.2a PRIOR ART
FIG.2b PRIOR ART
FIGS. 2*a* and 2*b*, which have already been described, respectively show a schematic view of a known tube formed by two tetrodes mounted upside down with respect to each other and a graph of the voltage and current present in the input cavity.

The same changes of current and voltage as shown in FIG. 2B are also obtained. Between the reference point A' and the reference point C', the electrical length is λ/4. As compared with the tube of FIG. 1*a*, the height of the active zone 30 is greater, thus enabling greater frequencies and power values to be attained.

The configuration with the two plate-type tuners 36 generally makes it possible to obtain low frequencies in the UHF range, for example between 450 and 550 MHz.

Figure 5:
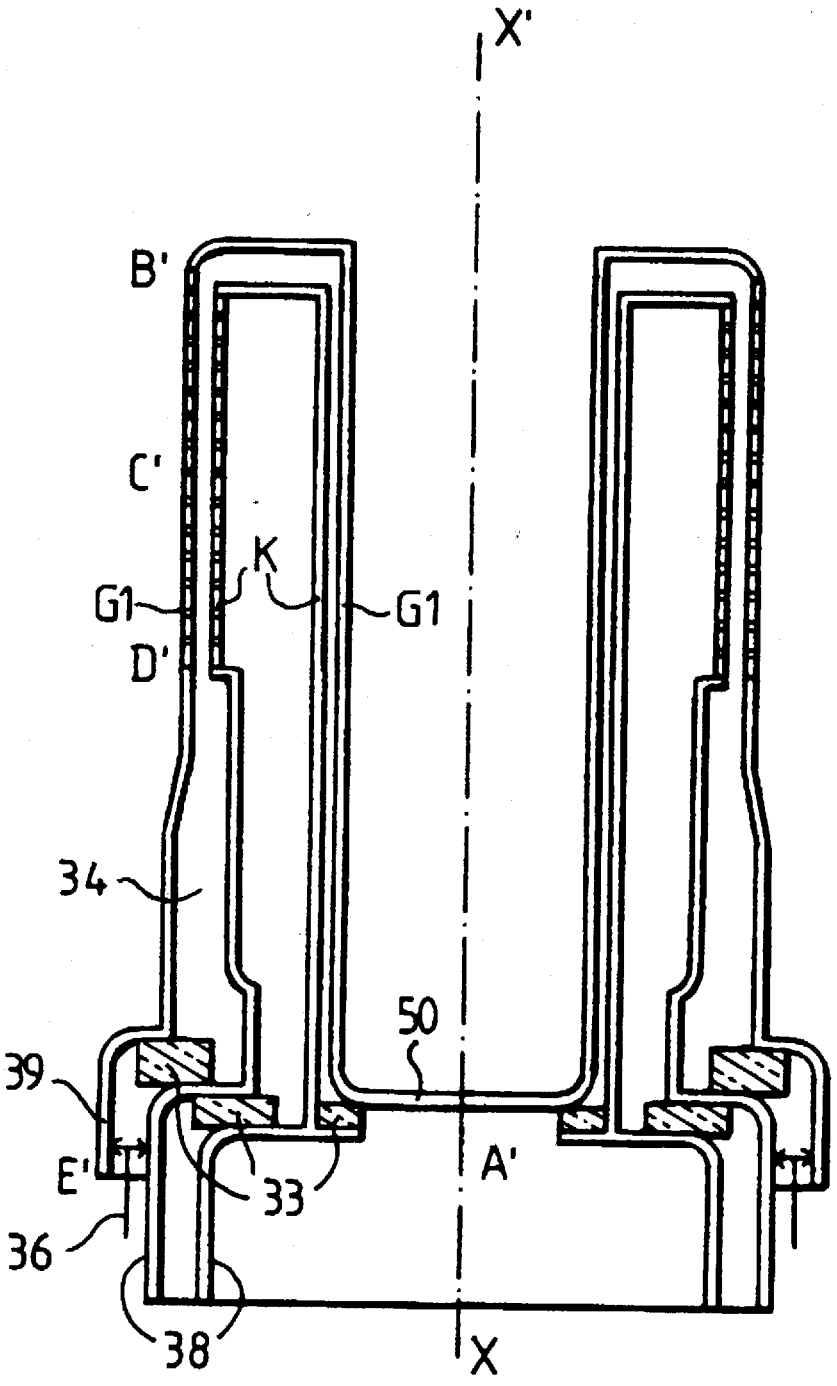
FIG. 5 shows a partial sectional view of a variant of a tube according to the invention.

To enable working in the higher frequencies of the UHF range, for example between 750 and 860 MHz, it is possible to envisage that at least one of the ends of the input cavity 34 will form an open circuit. This is shown in FIG. 5. It shows an input cavity 34 between the reference points A' and E'. One of its extremities ends in an open circuit at the reference point A'. This is the internal end. A plate-type tuner 36 closes the external end of the input cavity 34 at the reference point E'.

Figure 6A:
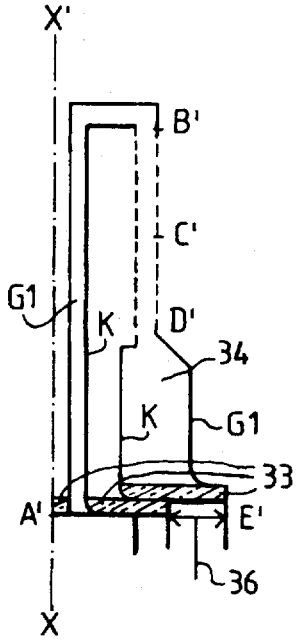
FIGS. 6*a* and 6*b* respectively show a schematic view of the tube of FIG. 5 and a graph of the voltage and current present in the input cavity.
Figure 6B:
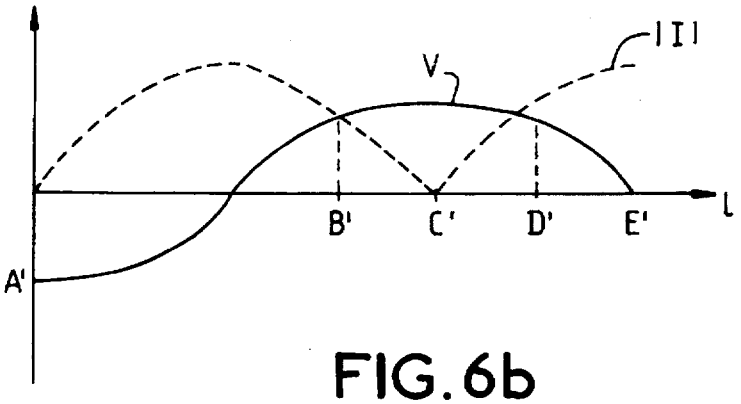

As further seen in FIG. 5, a conductive bottom 50 closes the internal end of the control grid G1 and the internal end of the cathode K conventionally ends in a collar 38. The reference point A' is located close to the axis XX'. At this place, the voltage V is the maximum. The input cavity 34 is then tuned in three quarter-wave mode as can be seen in FIG. 6*b* with reference to FIG. 6*a*. Between the reference point A' and the reference point C', the electrical length is λ/2.

Figure 7:
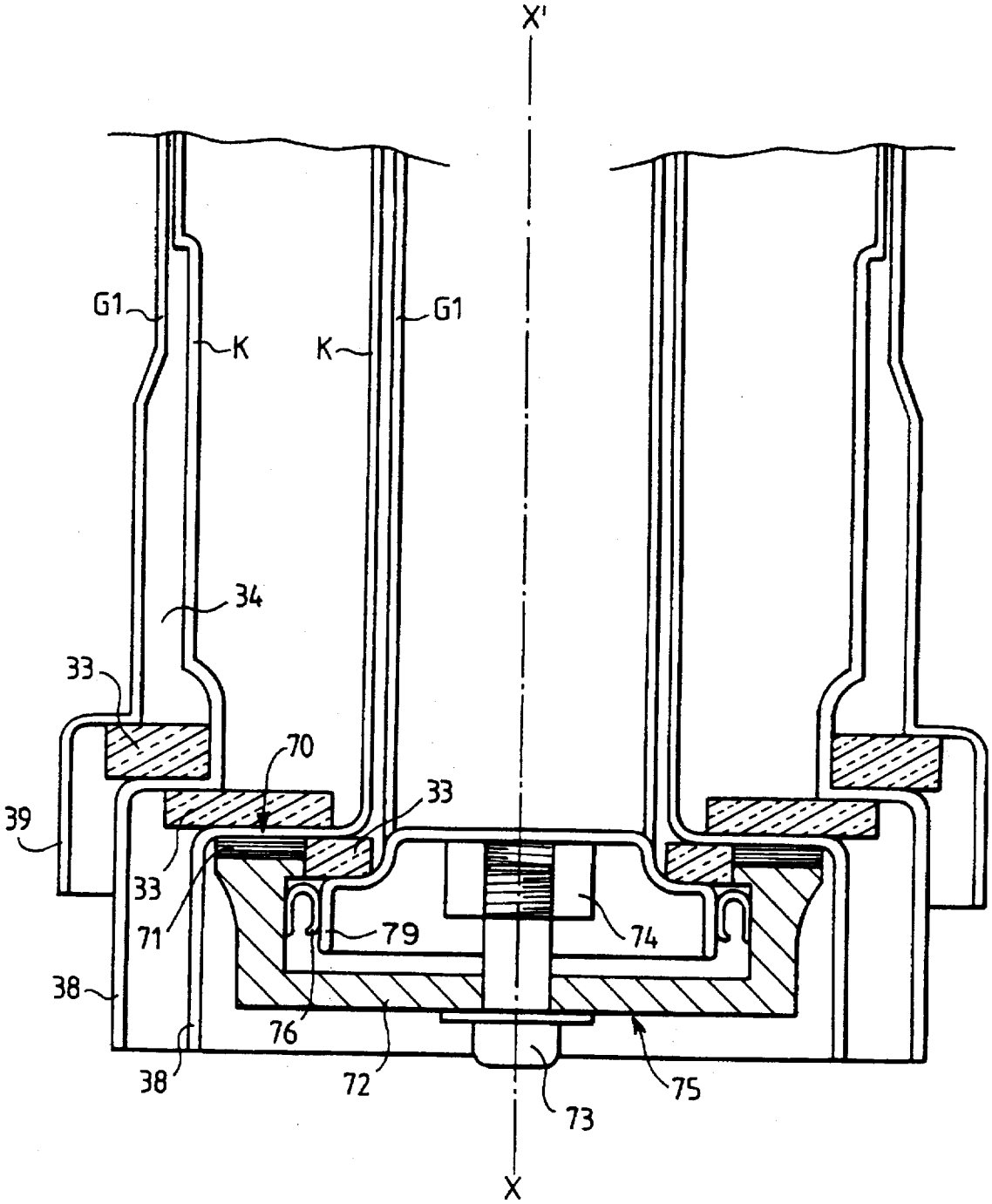
FIG. 7 shows a partial section of another variant of a tube according to the invention.

To make it possible to work at intermediate frequencies, for example between 550 and 750 MHz, it is possible to equip at least one end of the input cavity 34 with a capacitor connected with between the cathode K and the control grid G1. This is what is shown in FIG. 7 which shows only the base of the tube. A capacitor 70 is mounted at the internal end of the cavity. It has a dielectric element 71, made of mica for example, that is placed flat against the collar 38 of the cathode K by means of a conductive clamping device 75. The clamping device is preferably detachable. The dielectric element 71 is ring-shaped. Its thickness measured along the axis XX' and its surface area in contact with the collar 38 determine the value of the capacitor. The clamping device 75 is electrically and mechanically connected to the control grid G1. The clamping device 75 has a conductive plug 72 that comes into contact with the dielectric ring 71 and clamping means 73 such as a screw. The screw gets screwed into a bore 74 borne by the collar 79 of the control grid G1. The bore 74 is centered on the axis XX'. The collar 38 of the cathode K and the plug 72 form the electrodes of the capacitor.

A ring-shaped spring 76 may be designed to provide efficient contact between the plug 72 and the periphery of the collar 79 of the control grid G1. The plug 72 gets fitted about the periphery of the collar 79 of the control grid G1.

Figure 8A:
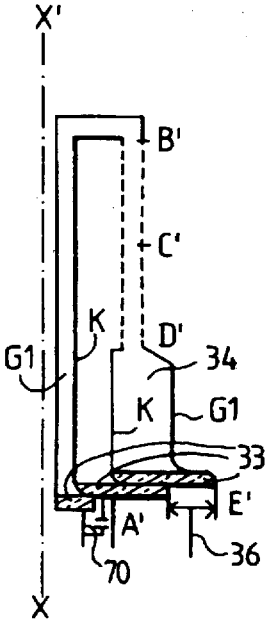
FIGS. 8*a* and 8*b* respectively show a schematic view of the tube of FIG. 7 and a graph of the voltage and current present in the input cavity.
Figure 8B:
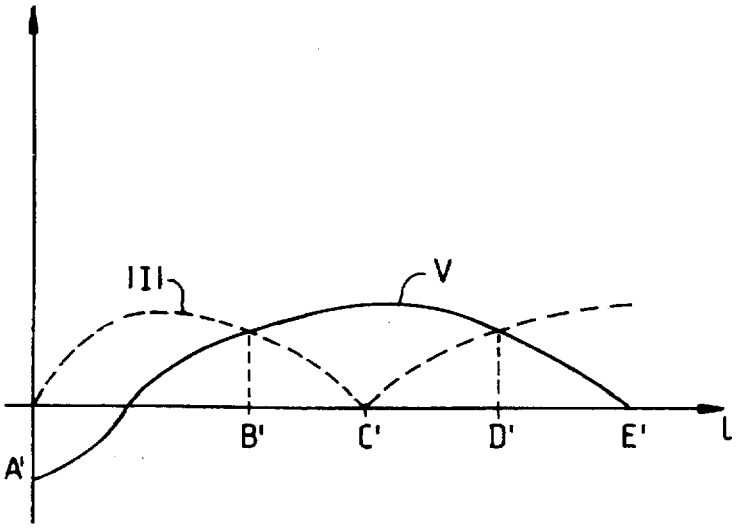

The development of the voltage and reactive current (in terms of absolute value) is shown in FIG. 8*b*, FIG. 8*a* giving a schematic view of the input cavity with its reference points.

The capacitor 70 is at the reference point A'. At this level, there is a voltage antinode and a current node. The electrical length between the reference point A' and the reference point C' ranges from λ/4 to λ/2.

The making of the capacitor of FIG. 7 is simple and does not raise any problem because the electrical ring 71 and the clamping device 75 are not subjected to a vacuum. An dielectric spacer 33 has been designed between the collar 38 of the cathode K and the collar 79 of the control grid G1 to ensure vacuum tightness.

The value of the capacitor 70 is a function of the thickness and surface area of the dielectric ring. The greater the thickness, the smaller the capacitance. The clamping device 75 may be detachable and a changing of capacitor is easy. The description that has just been given of the capacitor is but an example and other variants of the clamping device notably may be envisaged without departing from the framework of the invention.

What is claimed is:

1. An electron tube, comprising:

a plurality of generally cylindrical electrodes mounted coaxially about an axis, including a cathode and a grid, said grid surrounding said cathode;

an input resonant cavity defined by a region between said grid and said cathode, said input resonant cavity having an active zone and said input resonant cavity having extremities on both sides of said active zone;

said active zone having a central part at which a voltage reaches a maximum;

said resonant input cavity having a folded configuration so that both extremities of said input resonant cavity are at a common end of said tube.

2. An electron tube, comprising:

a plurality of generally cylindrical electrodes mounted coaxially about an axis, including a cathode and a grid, said grid surrounding said cathode;

an input resonant cavity defined by a region between said grid and said cathode, said input resonant cavity having an active zone and said input resonant cavity having extremities on both sides of said active zone;

said active zone having a central part at which a voltage reaches a maximum;

said resonant input cavity having a folded configuration so that both extremities of said input resonant cavity are at a base of said tube.

3. An electron tube according to claim 2, wherein at least one of the extremities of the input cavity is provided with a respective plate-type tuner.

4. An electron tube according to claim 2, wherein said input resonant cavity has at least one extremities which is a respective open circuit.

5. An electron tube according to claim 4, wherein the open circuit is located at the level of the axis.

6. An electron tube according to claim 2, wherein at least one of the extremities of the input cavity ends in a capacitor electrically connected between the grid and the cathode.

7. An electron tube according to claim 6, wherein the capacitor has a dielectric element placed flat against one of the cathode and grid by means of a conductive clamping device and in contact with the other of the cathode and grid.

8. An electron tube according to claim 7, wherein the clamping device is detachable.

9. An electron tube according to claim 7, wherein the clamping device comprises a conductive plug screwed into a collar fixedly joined to the other of the cathode and grid.

10. An electron tube according to claim 9, wherein a spring is positioned between the collar and the plug.

11. An electron tube according to claim 7, wherein the clamping device and the dielectric element are not subjected to vacuum.

12. An electron tube according to claim 7, wherein the dielectric element is ring-shaped.

13. An electron tube according to claim 7, wherein the dielectric element is compressed of mica.

14. An electron tube according to claim 7, wherein a value of the capacitance is adjustable.

* * * * *